US008689891B2

(12) United States Patent
Gette et al.

(10) Patent No.: US 8,689,891 B2
(45) Date of Patent: Apr. 8, 2014

(54) BALL AND DART LAUNCHER WITH PARALLEL AXIS RELEASE

(75) Inventors: Nicholas Peter Gette, Houston, TX (US); Marc Minassian, Montgomery, TX (US); James Christopher Clingman, Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 399 days.

(21) Appl. No.: 13/097,832

(22) Filed: Apr. 29, 2011

(65) Prior Publication Data

US 2012/0273198 A1 Nov. 1, 2012

(51) Int. Cl.
*E21B 33/12* (2006.01)
*E21B 34/14* (2006.01)

(52) U.S. Cl.
CPC ..... *E21B 34/14* (2013.01); *E21B 33/12* (2013.01)
USPC ..... 166/386; 166/75.15; 166/192; 166/193

(58) Field of Classification Search
USPC ..... 166/381, 386, 75.15, 192, 193, 194
See application file for complete search history.

(56) References Cited

U.S. PATENT DOCUMENTS 4,651,970 A * 3/1987 Sadler ..... 251/63.6
4,944,348 A * 7/1990 Whiteley et al. ..... 166/278
5,890,537 A 4/1999 Lavaure et al.
2008/0296012 A1* 12/2008 Peer et al. ..... 166/75.15
2010/0175891 A1 7/2010 Rondeau et al.
2012/0152525 A1 6/2012 McGuire

FOREIGN PATENT DOCUMENTS

GB 2458046 A 9/2009
GB 2469590 A 10/2010

OTHER PUBLICATIONS

Search Report from corresponding GB Application No. GB1207312.8 dated Jul. 30, 2012.
Search Report from corresponding GB Application No. GB1207312.8 dated Sep. 7, 2012.

* cited by examiner

*Primary Examiner* — Cathleen Hutchins
(74) *Attorney, Agent, or Firm* — Bracewell & Giuliani LLP

(57) ABSTRACT

A universal dart launcher launches a dart by moving a dart from a first position to a second position. The universal dart launcher has a launcher body defining a central bore having an axis and lower and upper ends configured to attach to a string of pipe. A cartridge housed within the launcher body may move perpendicular to the axis from a first position to a second position. A drop member is positioned within the cartridge so that it will not be in axial alignment with the central bore while in the first position, and will be in axial alignment with the central bore while in the second position. An actuator assembly couples to the launcher body to move the cartridge from the first position to the second position when actuated.

28 Claims, 8 Drawing Sheets

BALL AND DART LAUNCHER WITH PARALLEL AXIS RELEASE

BACKGROUND OF THE INVENTION

1. Field of the Invention

This invention relates in general to drop balls, plugs, or darts used to operate running tool functions and, in particular, to a universal launcher for launching a drop ball, plug, or dart into a running string.

2. Brief Description of Related Art

Standard dart or ball launchers have a member that defines a central bore that may be coupled inline with a drill or tubing string. The launchers also include an angular bore that intersects the central bore at a shallow angle between the angular bore and the central bore. A dart or ball is dropped into the angular bore, and after opening a series of valves, the ball or dart is introduced into the central bore for further movement of the dart or ball down the borehole. There, the dart or ball will land at a predetermined location to block the borehole and allow hydraulic tool operations. In order to minimize the potential that the ball will snag or hang up as it moves from the angular bore to the central bore, the angle of the intersection between the two axes is as close to zero degrees as possible. This necessitates that the launcher must be very tall to smooth out the transition between the angular bore and the central bore. The height can make the launcher very difficult to access and operate. Despite incredibly shallow angles, many times the dart or ball hangs up or snags where the angular bore meets the central bore; this prevents operation of the downhole tool, and necessitates that the launcher be broken out and reset for further operations down the tubing or drill string.

Other devices couple inline with the drill or tubing string and use a series of valves to launch the ball or dart. Again, the dart or ball may become stuck or snagged at the valve openings, preventing successful operation of the dart or drop ball. In addition, these types of devices require bypass passages within the valves so that fluids may flow around the darts and valves prior to launching the dart or ball. These passages restrict fluid flow through the running string and may become clogged. Clogging of these passages will, in turn, require stoppage of drilling operations in order to remove and reset the launcher for operation. Even when not blocked, these passages may restrict the flow of fluid down hole, causing further complications in drilling operations. Thus, there is a need for a launcher that launches the dart or ball from an inline coupling without restricting fluid flow through the central bore of the tubing.

SUMMARY OF THE INVENTION

These and other problems are generally solved or circumvented, and technical advantages are generally achieved, by preferred embodiments of the present invention that provide a universal ball and dart launcher with an actuator and a method for using the same.

In accordance with an embodiment of the present invention, a wellbore drop member launcher is disclosed. The wellbore drop member launcher includes a launcher body defining a central bore having an axis. The launcher body has a lower end configured to attach to a string of pipe extending into a wellbore and an upper end configured for attachment to a source of fluid to be pumped down the string of pipe. A cartridge is housed within the launcher body so that the cartridge may move perpendicular to the axis from a first position to a second position within the launcher body. A drop member is positioned within the cartridge so that the drop member will not be in axial alignment with the central bore while the cartridge is in the first position, and will be in axial alignment with the central bore while the cartridge is in the second position. The wellbore drop member launcher includes an actuator assembly coupled to the launcher body so that the actuator assembly may operate to move the cartridge from the first position to the second position.

In accordance with another embodiment of the present invention, a wellbore drop member launcher is disclosed. The drop member launcher includes a launcher body defining a central bore having an axis, the launcher body having a lower end configured to attach to a string of pipe extending into a wellbore and an upper end configured for attachment to a source of fluid to be pumped down the string of pipe. The launcher body further defines a cartridge slot intersecting the central bore and having a radially extending width greater than a diameter of the central bore. The drop member launcher includes a cartridge housed within the launcher body so that the cartridge may move perpendicular to the axis from a first position to a second position within the cartridge slot. The cartridge defines an axially extending open bore having a diameter that is substantially the same as the diameter of the central bore, and an axially extending drop member bore having a diameter that substantially the same as the diameter of the central bore. The cartridge is moveable within the launcher body so that the open bore is aligned with the central bore in the first position and the drop member bore is aligned with the central bore in the second position. A drop member is positioned within the cartridge so that the drop member will not be in axial alignment with the central bore while the cartridge is in the first position, and will be in axial alignment with the central bore while the cartridge is in the second position. The drop member launcher also includes an actuator assembly coupled to the launcher body so that the actuator assembly may operate to move the cartridge from the first position to the second position.

In accordance with yet another embodiment of the present invention, a method for launching a drop member into a wellbore pipe string is disclosed. The method begins by providing a launcher body having a central bore with an axis and a slot joining and extending from the central bore perpendicular to the axis. Then, the method places a drop member in the slot in a staging position laterally spaced from the central bore. The launcher body is then coupled in line with the pipe string so that the central bore of the launcher body aligns with a body passage through the pipe string. The drop member is then pushed from the slot into the central bore and pumped down the pipe string and through the central bore to convey the drop member down the pipe string.

In still another embodiment, a well tool assembly is disclosed. The well tool assembly includes a running tool adapted to be coupled to a running string. The running tool has at least one hydraulically actuated function. The well tool assembly also includes a drop member launcher adapted to be coupled to an upper end of the running string. The drop member launcher has a central bore capable of fluid communication with a central bore of the running string and the running tool. The drop member launcher is configured to move a drop member within the drop member launcher perpendicular to the central bore of the drop member launcher to place the drop member inline with the central bore of the running string. This will cause the drop member to travel down the running string to land in a landing sub of the running tool.

In yet another embodiment, a method for operating a running tool is disclosed. The method begins by providing a well tool assembly. The well tool assembly has a running tool adapted to be coupled to a running string. The running tool has at least one hydraulically actuated function. The well tool assembly also includes a landing sub coupled to a lower end of the running tool. A drop member launcher carrying a drop member couples to an upper end of the running string opposite the running tool. The method continues by moving a drop member perpendicular to a central bore of the drop member launcher from a first position to a second position to align the drop member with a central bore of the running string. The drop member then moves down the running string to land in the landing sub, thereby blocking fluid flow through the landing sub and hydraulically actuating the running tool. The method continues by supplying fluid pressure to the running tool at a first pressure to actuate the running tool to perform a function.

Disclosed embodiments provide a dart or ball launching system that decreases the instances of blockage or snagging of the dart or ball during launch. In addition, the disclosed embodiments provide an unrestricted flow passage through the launcher and central bore of a drill string when the launcher is not in use. These are accomplished with a launcher that is biased to the non-launching position to prevent inadvertent launching of the dart or ball and inadvertent blockage of the coupled running string.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, hydraulic tool manufacture, hydraulic tool operation, hydraulic tool uses, and the like have been omitted inasmuch as such details are not considered necessary to obtain a complete understanding of the present invention, and are considered to be within the skills of persons skilled in the relevant art.

Figure 1:
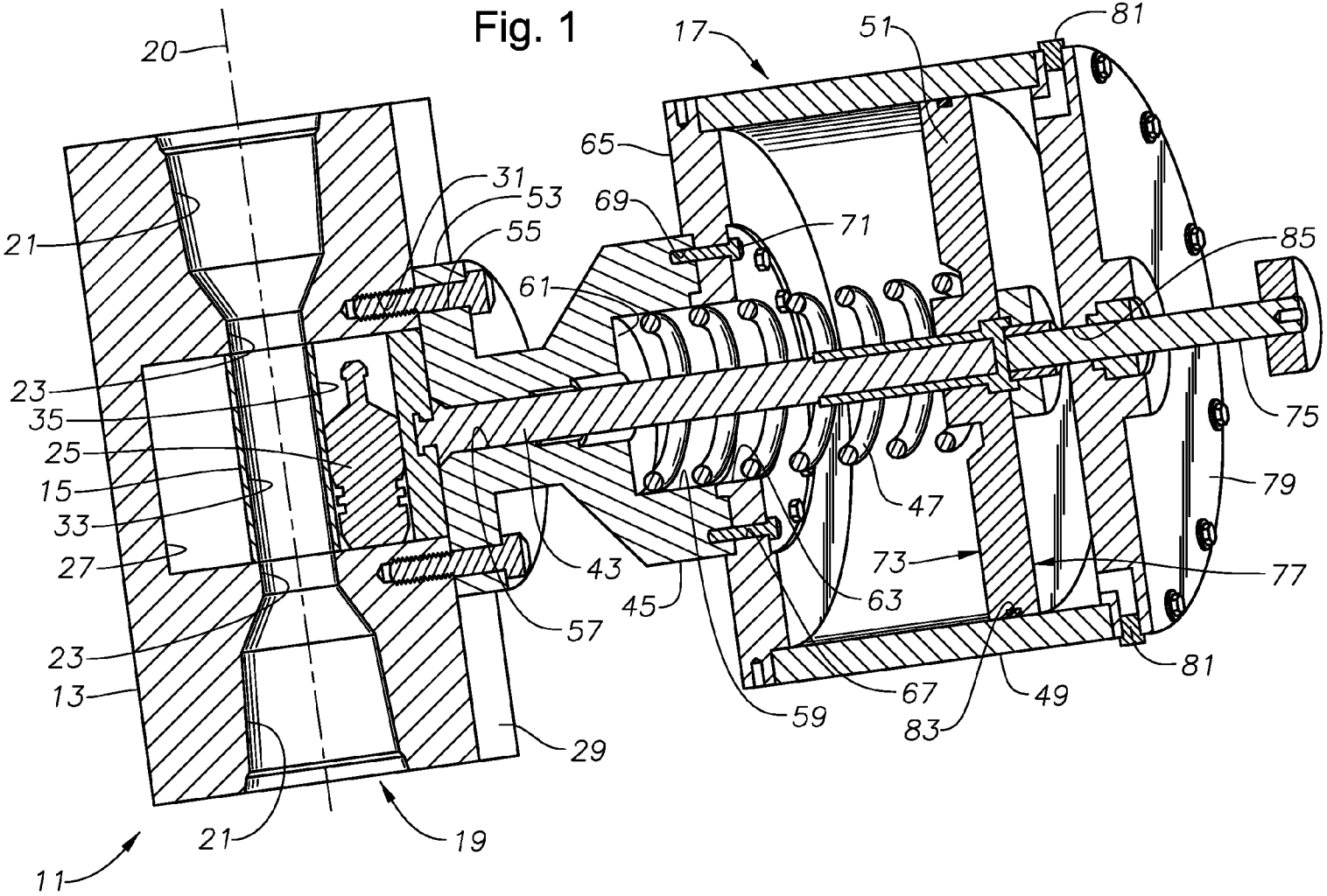
FIG. 1 is sectional view of a universal dart launcher in accordance with an embodiment of the present invention.
Figure 2:
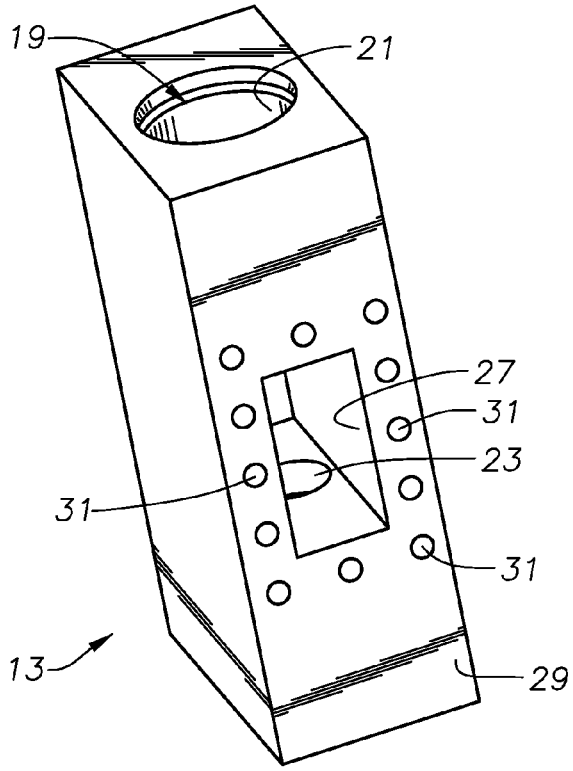
FIG. 2 is a schematic perspective view of a launcher body of the universal dart launcher of FIG. 1.

Referring to FIG. 1, a universal dart launcher 11 is shown in a first position, or staging position, and includes a launcher body 13, a launcher cartridge 15, and a launcher actuator 17. As illustrated and described herein, launcher actuator 17 may be a pneumatic actuator. A person skilled in the art will understand that launcher actuator 17 may comprise any suitable actuation assembly that may move cartridge 15 from the position of FIG. 1 to the position of FIG. 4 as described in more detail below.

As illustrated in FIG. 1, launcher body 13 may be a cuboid body adapted to couple inline with a string of pipe (not shown), such as a running string, at upper and lower ends of launcher body 13. The coupling between the running string and launcher body 13 may comprise a flanged coupling, a threaded coupling, a welded coupling, or any other suitable means of securing universal dart launcher 11 to a running string during operation of universal dart launcher 11 as described below. Launcher body 13 may alternatively comprise a tubular body. Launcher body 13 defines a central bore 19 having an axis 20. In the illustrated embodiment, central bore 19 has a wider diameter 21 at upper and lower ends proximate to running string couplings at the upper and lower ends of launcher body 13 and a narrower diameter 23 at a middle portion of central bore 19. Central bore 19 tapers from wider diameter 21 to narrower diameter 23. In the illustrated embodiment, narrower diameter 23 has a diameter approximately equivalent to the diameter of a dart 25. A person skilled in the art will understand that dart 25 may also comprise any suitable drop member, such as a drop ball or plug. Similarly, a person skilled in the art will understand that dart 25 may be a non-latching type dart as shown, or alternatively a latching type dart.

Launcher body 13 also defines a cartridge slot 27 extending from an exterior surface 29 of launcher body 13 inward toward central bore 19. Cartridge slot 27 passes through bore 19 such that cartridge 15 may move through central bore 19 perpendicular to axis 20 as described in more detail below. Threaded bores 31 may be formed in surface 29 of launcher body 13. As described in more detail below, threaded bores 31 allow for coupling of launcher actuator 17 to launcher body 13.

Figure 3:
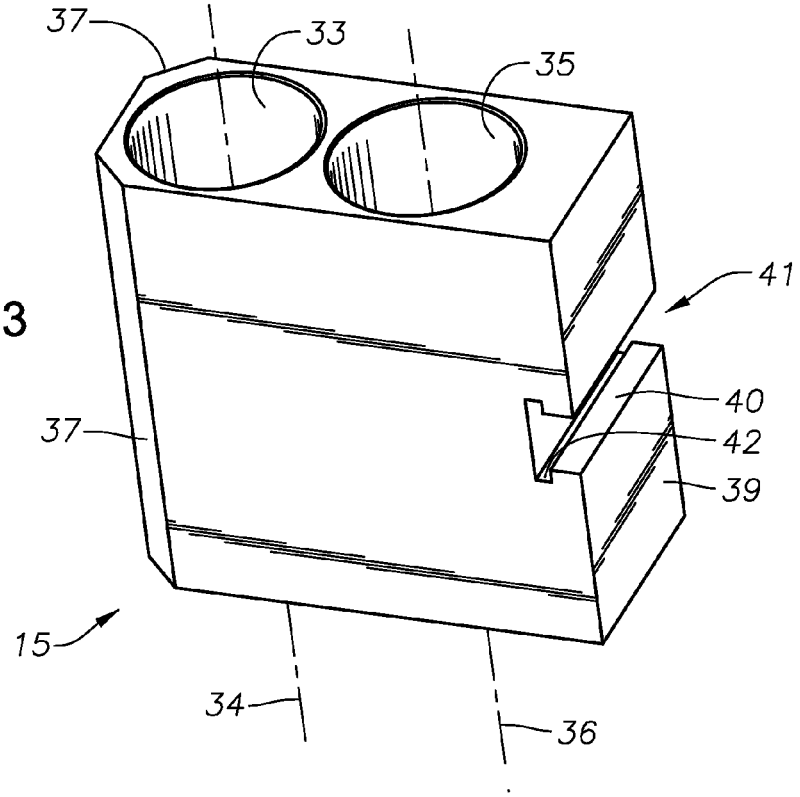
FIG. 3 is a schematic perspective view of a cartridge of the universal dart launcher of FIG. 1.

As shown in FIG. 3, cartridge 15 comprises a cuboid body having an open bore 33 and a dart bore 35. Cartridge 15 is of a size and shape such that cartridge 15 will substantially fill cartridge slot 27 while remaining able to slide through cartridge slot 27 perpendicular to axis 20. In the illustrated embodiment, the diameters of open bore 33 and dart bore 35 are approximately equal and approximately equal to narrower diameter 23 of central bore 19. Thus, when cartridge 15 moves horizontally through cartridge slot 27, first open bore 33 and then dart bore 35 will align with and become coaxial with narrower diameter 23 of central bore 19. As shown in FIG. 1, dart 25 will reside in dart bore 35 prior to pumping of dart 25 downhole as described in more detail below.

As shown in FIG. 3, cartridge 15 includes beveled edges 37. Beveled edges 37 run an axial length of cartridge 15 and aid in aligning cartridge 15 with the portion of cartridge slot 27 opposite launcher actuator 17 when cartridge 15 moves horizontally through cartridge slot 27. An exterior end 39 of cartridge 15 opposite beveled edges 37 defines an actuator slot 41. Actuator slot 41 may comprise a T-shaped slot as shown extending the width of cartridge 15 perpendicular to axes 34, 36 passing through open bore 33 and dart bore 35, respectively. A leg 40 of actuator slot 41 extends from end 39 inward to a bar 42 of actuator slot 41 proximate to dart bore 35. An actuator rod 43 may insert into and secure within actuator slot 41 as described in more detail below.

As illustrated in FIG. 1, the illustrative launcher actuator 17 includes actuator rod 43, an attachment body 45, a retraction spring 47, a hydraulic chamber 49, and a hydraulic piston 51. Attachment body 45 has a flange 53 on a first end. Flange 53 has a plurality of bores 55 positioned to align with threaded bores 31 of launcher body 13. Bolts (not shown) may be inserted into bores 55 and threaded into threaded bores 31 to secure attachment body 45 to launcher body 13. Any suitable means may be used to secure attachment body 45 to launcher body 13, such that a seal will be formed between launcher body 13 and attachment body 45, preventing fluid from passing out of cartridge slot 27 at surface 29. Attachment body 43 also defines a rod bore 57 for the passage of actuator rod 43. In the illustrated embodiment, actuator rod 43 will be inserted through rod bore 57 during assembly of universal dart launcher 11. An end of actuator rod 43 will then be inserted into actuator slot 41 from either a front or back portion of cartridge 15. The end of actuator rod 43 has a profile to match the T-shaped profile of actuator slot 41. A person skilled in the art will understand that the end of actuator rod 43 and actuator slot 41 may comprise any suitable matching profile. Cartridge 15 may then be inserted into cartridge slot 27 and attachment body 45 secured to launcher body 13 at threaded bores 31 and bores 55. In this manner, cartridge 15 will be secured within launcher body 13, and actuator rod 43 will be blocked from leaving actuator slot 41 by interior walls defining cartridge slot 27.

Attachment body 45 may include a counterbore 59 extending inward from an end opposite flange 53. Counterbore 59 is coaxial with rod bore 57 and defines an outwardly facing shoulder 61 at the transition from counterbore 59 to rod bore 57. A first end of spring 47 abuts outwardly facing shoulder 61 and extends past an outer rim of attachment body 45. As shown, spring 47 is a coil spring having a diameter substantially equivalent to the diameter of counterbore 59. A second end of spring 47 passes through a spring opening 63 in a first end 65 of piston chamber 49. As shown, spring opening 63 has a diameter approximately equivalent to the diameter of counterbore 59. First end 65 may include bores 67 positioned to align with matching bores 69 in a rim of attachment body 47. In the illustrated embodiments, bolts 71 thread into bores 67, 69 to secure piston chamber 49 to attachment body 45. A person skilled in the art will understand that any suitable means to secure piston chamber 49 to attachment body 45 is contemplated and included in the disclosed embodiments.

Actuator rod 43 passes through a center of spring 47 and mounts to piston 51 within piston chamber 49. In the illustrated embodiment, actuator rod 43 is of a length such that when universal dart launcher 11 is in the non-launching position shown in FIG. 1, spring 47 will be uncompressed and have a second end seated to a first surface 73 of piston 51. An indicator rod 75 may couple to piston 51 and extend from a second surface 77 outwardly through a second end 79 of piston chamber 49. A person skilled in the art will understand that actuator rod 43 and operation rod 75 may be a single member.

In a first embodiment, second end 79 includes hydraulic ports 81. Hydraulic ports 81 provide access to an interior of piston chamber 49 so that fluid may be applied within piston chamber 49 to second surface 77 of piston 51, moving piston 51 from the position shown in FIG. 1 to the position shown in FIG. 4. Preferably, at least one hydraulic port 81 will operate to receive fluid pressure, and at least one port 81 will operate to allow release of hydraulic pressure from piston chamber 49. Piston 51 may include an o-ring seal 83 sealing piston 51 to piston chamber 49 to prevent passage of fluid proximate or adjacent to first surface 73 from moving to an area proximate to or adjacent to second surface 77 and vice versa. Indicator rod 75 will include a seal at second end 79 sealing the opening through which indicator rod 75 passes into piston chamber 49. Indicator rod 75 will move with piston 51 to provide an indicator of the position of piston 51 within piston chamber 49 and cartridge 15 within cartridge slot 27. A person skilled in the art will understand that hydraulic ports 81 may also comprise pneumatic ports for the reception and release of pneumatic pressure. In an alternative operative embodiment, an operator may then manually push indicator rod 75 through an indicator rod bore 85 to move indicator rod 75 and, in response, piston 51 away from second end 79 of piston chamber 49. A person skilled in the art will understand that launcher actuator 17 as illustrated and described herein is exemplary. Any suitable mechanism to move cartridge 15 through launcher body 13 may be used and are contemplated and included in the disclosed embodiments.

Figure 4:
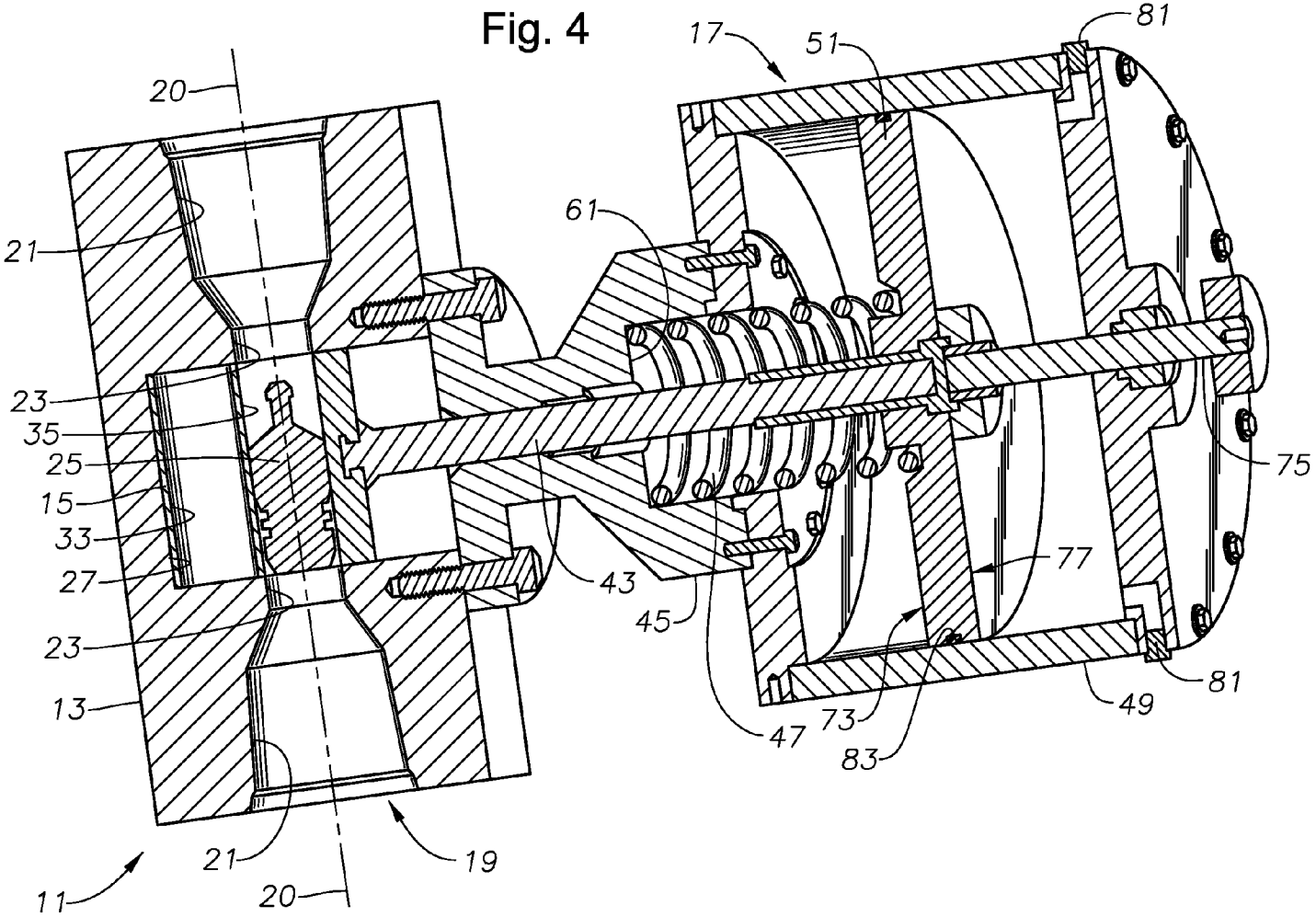
FIG. 4 is a sectional view of the universal dart launcher of FIG. 1 in a second position.

Referring to FIG. 4, universal dart launcher 11 is shown in a second position following actuation of universal dart launcher 11. In an operative embodiment, universal dart launcher 11 will initially be in the position shown in FIG. 1. Hydraulic fluid pressure will be applied to piston chamber 49 at hydraulic ports 81. The increase in hydraulic pressure within piston chamber 49 will exert a force on surface 77 of piston 51. In response, piston 51 will move toward first end 65 of piston chamber 49, and away from second end 79 of piston chamber 49 as shown in FIG. 4. This, in turn, will cause actuator rod 43 to move into cartridge slot 27, forcing cartridge 15 through cartridge slot 27. Movement of cartridge 15 will continue until the end of cartridge 15 contacts the end of cartridge slot 27, thus aligning dart bore 35 with central bore 19 at narrower diameter 23. Dart 25 will now block central bore 19 at narrower diameter 23. An increase of fluid pressure behind dart 25 (axially upward) will cause dart 25 to move axially downward from the position shown in FIG. 4. Dart 25 may then fall due to the force of gravity or be pumped down the running string coupled axially below launcher body 13 to land on a dart landing shoulder at a predetermined location within the drill string.

As piston 51 moves into the position shown in FIG. 4, spring 47 will compress between piston 51 and outwardly facing shoulder 61. This will cause spring 47 to exert a force on first surface 73 of piston 51, biasing piston 51 to the position shown in FIG. 1. Removal of hydraulic pressure from hydraulic ports 81 will allow spring 47 to move piston 51 from the position of FIG. 4 to the position of FIG. 1. In this manner, universal dart launcher 11 will be biased to the non-launching position, preventing inadvertent blocking of central bore 19 and the drill string coupled to launch body 13 or premature launching of dart 25. A person skilled in the art will understand that many suitable launcher actuators 17 may be used provided that the alternative launcher actuators 17 operate generally as disclosed herein and bias cartridge 15 to the non-launching position. As disclosed herein threaded bores 31 are arranged so as to be readily adaptable to alternative launcher actuators 17.

Figure 5:
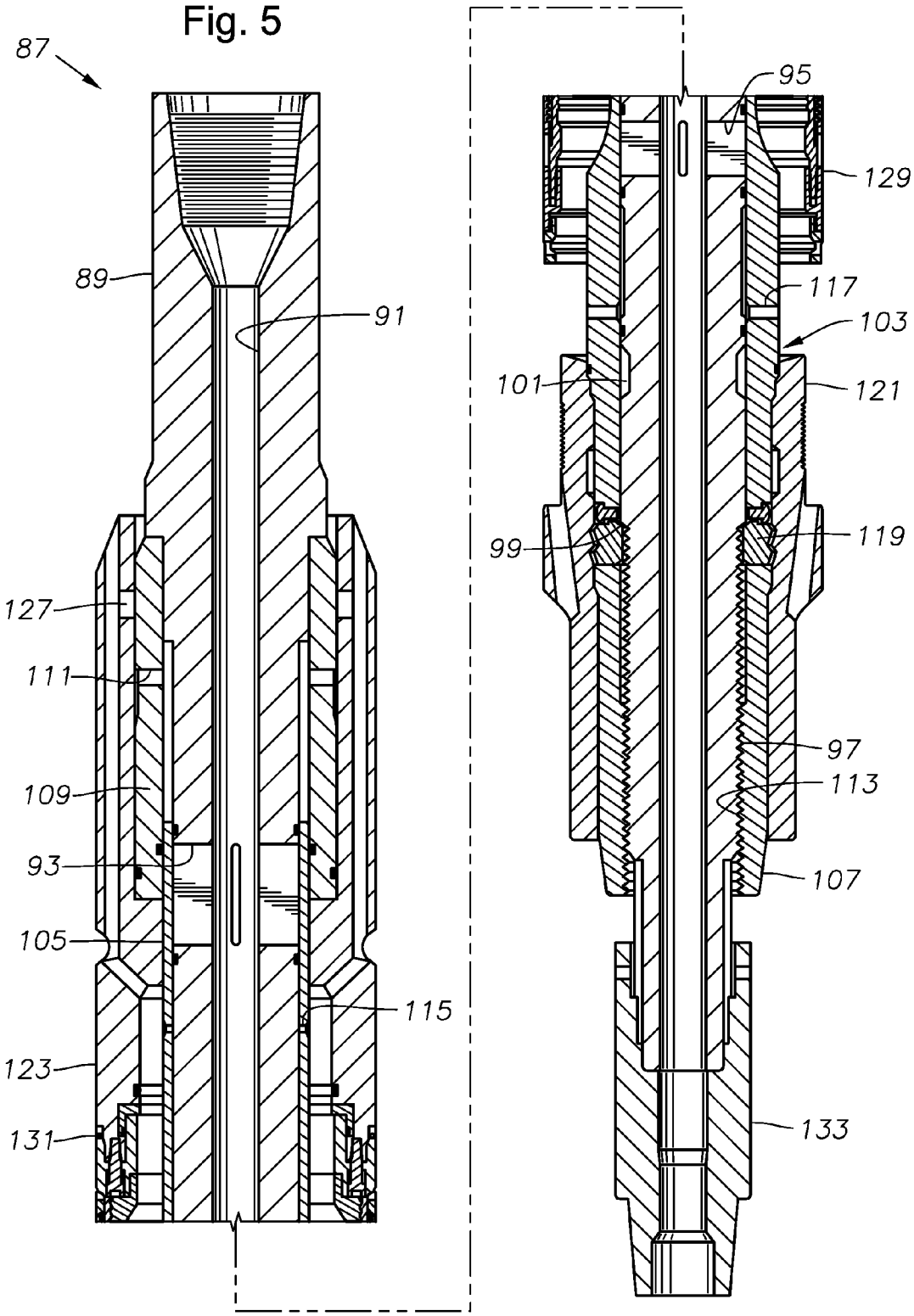
FIG. 5 is a sectional view of a high capacity running tool (HCRT) constructed with a piston cocked, and an engagement element retracted.

Referring to FIG. 5, there is generally shown an embodiment for a high capacity running tool 87 that is used to set and internally test a casing hanger packoff. High capacity running tool 87 is comprised of a stem 89. Stem 89 is a tubular member with an axial passage 91 extending therethrough. Stem 89 connects on its upper end to a string of drill pipe (not shown) that in turn connects to a lower end of launcher body 13 so that central bore 19 of launcher body 13 is in fluid communication with axial passage 91 of running tool 87. Stem 89 has an upper stem port 93 and a lower stem port 95 positioned in and extending therethrough that allow fluid communication between the exterior and axial passage of stem 89. A lower portion of stem 89 has threads 97 in its outer surface. The outer diameter of an upper portion of stem 89 is greater than the outer diameter of the lower portion of stem 89 containing threads 97. As such, a downward facing shoulder 99 is positioned adjacent threads 97. A recessed pocket 101 is positioned in the outer surface of stem 89 at a select distance above downward facing shoulder 99.

High capacity running tool 87 has a body 103 that surrounds stem 89, as stem 89 extends axially through body 103. Body 103 has an upper body portion 105 and a lower body portion 107. Upper portion 105 of body 103 is a thin sleeve located between an outer sleeve 109 and stem 89. Outer sleeve 109 is rigidly attached to stem 89. A latch device (not shown) is housed in a slot 111 located within outer sleeve 109. Lower body portion 107 of body 103 has threads 113 along its inner surface that are engaged with threads 97 on the outer surface of stem 89. Body 103 has an upper body port 115 and a lower body port 117 positioned in and extending therethrough that allow fluid communication between the exterior and interior of the stem body 103. Lower body portion 107 of body 103 houses an engaging element 119. In this particular embodiment, engaging element 119 is a set of dogs having a smooth inner surface and a contoured outer surface. The contoured outer surface is adapted to engage a complimentary contoured surface on the inner surface of a casing hanger 121 when engaging element 119 is engaged with casing hanger 121. Although not shown, a string of casing is attached to the lower end of casing hanger 121. The inner surface of engaging element 119 is initially in contact with threads 97 on the inner surface of stem 89.

Figure 7:
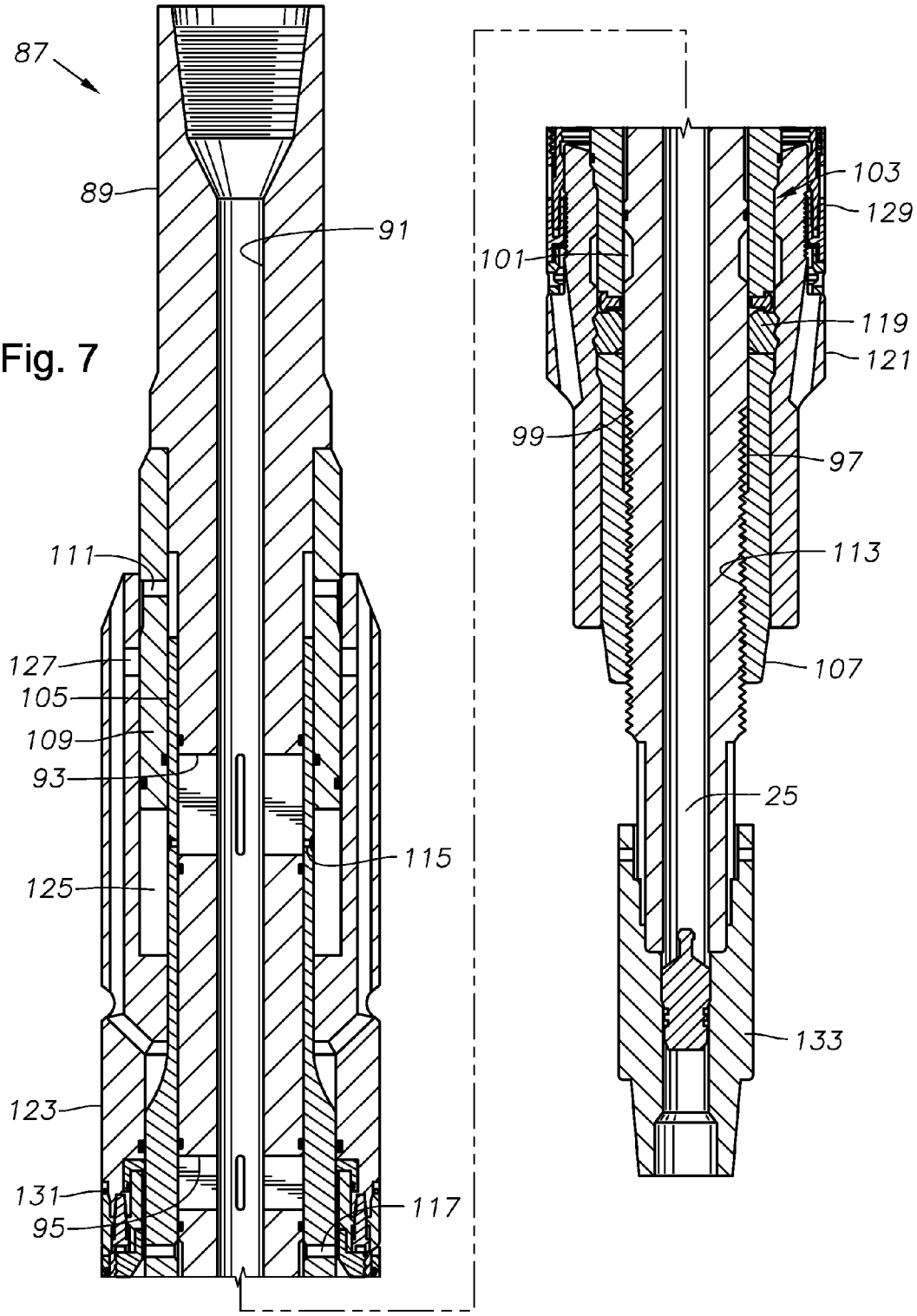
FIG. 7 is a sectional view of the HCRT of FIG. 5 in a setting position.

A piston 123 surrounds stem 89 and substantial portions of body 103. Referring to FIG. 7, a piston chamber 125 is formed between upper body portion 105, outer sleeve 109, and piston 123. Piston 123 is initially in an upper or "cocked" position relative to stem 89, meaning that the area of piston chamber 125 is at its smallest possible value, allowing for piston 123 to be driven downward. A piston locking ring 127 extends around the outer peripheries of the inner surface of piston 123. Piston locking ring 127 works in conjunction with the latch device (not shown) contained within outer sleeve slot 111 to restrict movement of the piston during certain running tool functions. A casing hanger packoff seal 129 is carried by piston 123 and is positioned along the lower end portion of piston 123. Casing hanger packoff seal 129 will act to seal casing hanger 121 to the wellbore (not shown) when properly set. While piston 123 is in the upper or "cocked" position, casing hanger packoff seal 129 is spaced above casing hanger 121.

A dart landing sub 133 is connected to the lower end of stem 89. Dart landing sub 133 will act as a landing point for an object, such as dart 25, that will be lowered into stem 89 by dart launcher 11. When dart 25 lands within dart landing sub 133, it will act as a seal, effectively sealing the lower end of stem 89.

Referring to FIG. 5, in operation, high capacity running tool 87 is initially positioned such that it extends axially through a casing hanger 121. Piston 123 is in a "cocked" position, and the stem ports 93, 95 and body ports 115, 117 are axially offset from one another. Casing hanger packoff seal 129 is carried by piston 123. High capacity running tool 87 is lowered into casing hanger 121 until the outer surface of body 103 of high capacity running tool 87 slidingly engages the inner surface of casing hanger 121.

Figure 6:
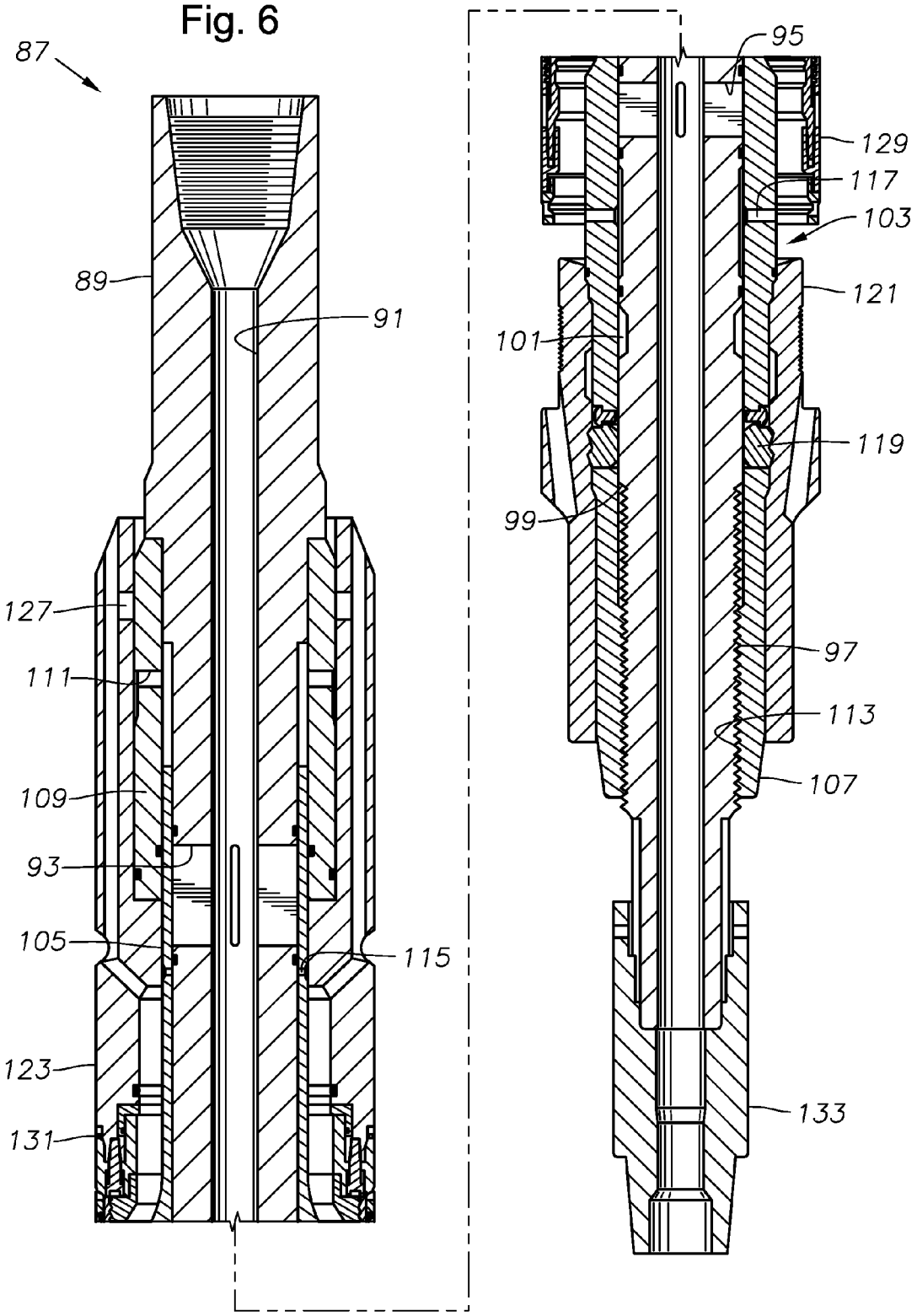
FIG. 6 is a sectional view of the HCRT of FIG. 5 in a running position with the engagement element engaged.

Referring to FIG. 6, once high capacity running tool 87 and casing hanger 121 are in abutting contact with one another, stem 89 is rotated four revolutions. As stem 89 is rotated relative to body 103, stem 89 and piston 123 move longitudinally downward relative to body 103. As stem 89 moves longitudinally, shoulder 99 on the outer surface of stem 89 makes contact with engaging element 119, forcing it radially outward and in engaging contact with the inner surface of casing hanger 121, thereby locking body 103 to casing hanger 121. As stem 89 moves longitudinally, stem ports 93, 95 and body ports 115, 117 also move relative to one another.

Referring to FIG. 7, once high capacity running tool 87 and casing hanger 121 are locked to one another, high capacity running tool 87 and casing hanger 121 are lowered down the riser into the subsea wellhead housing (not shown) until casing hanger 121 comes to rest. Referring to FIG. 4, pneumatic or fluid pressure is applied to launcher actuator 17 to move piston 51 away from second end 79 of launcher actuator 17 as described above. This will move cartridge 15 through cartridge slot 27 to align dart bore 35 of cartridge 15 with central bore 19 of launcher body 13. Dart 25 will then move free of dart bore 35 under the force of gravity to travel down the drill string connecting central bore 19 with axial passage 91.

Referring to FIG. 7, dart 25 lands in dart landing sub 133, thereby sealing the lower end of stem 89. Stem 89 is then rotated four additional revolutions in the same direction. As stem 89 is rotated relative to body 103, stem 89 and piston 123 move further longitudinally downward relative to body 103 and casing hanger 121. As stem 89 moves longitudinally, stem ports 93, 95 and body ports 115, 117 also move relative to one another. Upper stem port 93 aligns with upper body port 115, but lower stem port 95 is still positioned above lower body port 117. This position allows fluid communication from axial passage 91 of stem 89, through stem 89, into and through body 103, and into piston 123. Fluid pressure is applied down the drill pipe and travels through axial passage 91 of stem 89 before passing through upper stem port 93, upper body port 115, and into chamber 125, driving piston 123 downward relative to stem 89. As piston 123 moves downward, the movement of piston 123 sets the casing hanger packoff seal 129 between an outer portion of casing hanger 121 and the inner diameter of the subsea wellhead housing.

Figure 8:
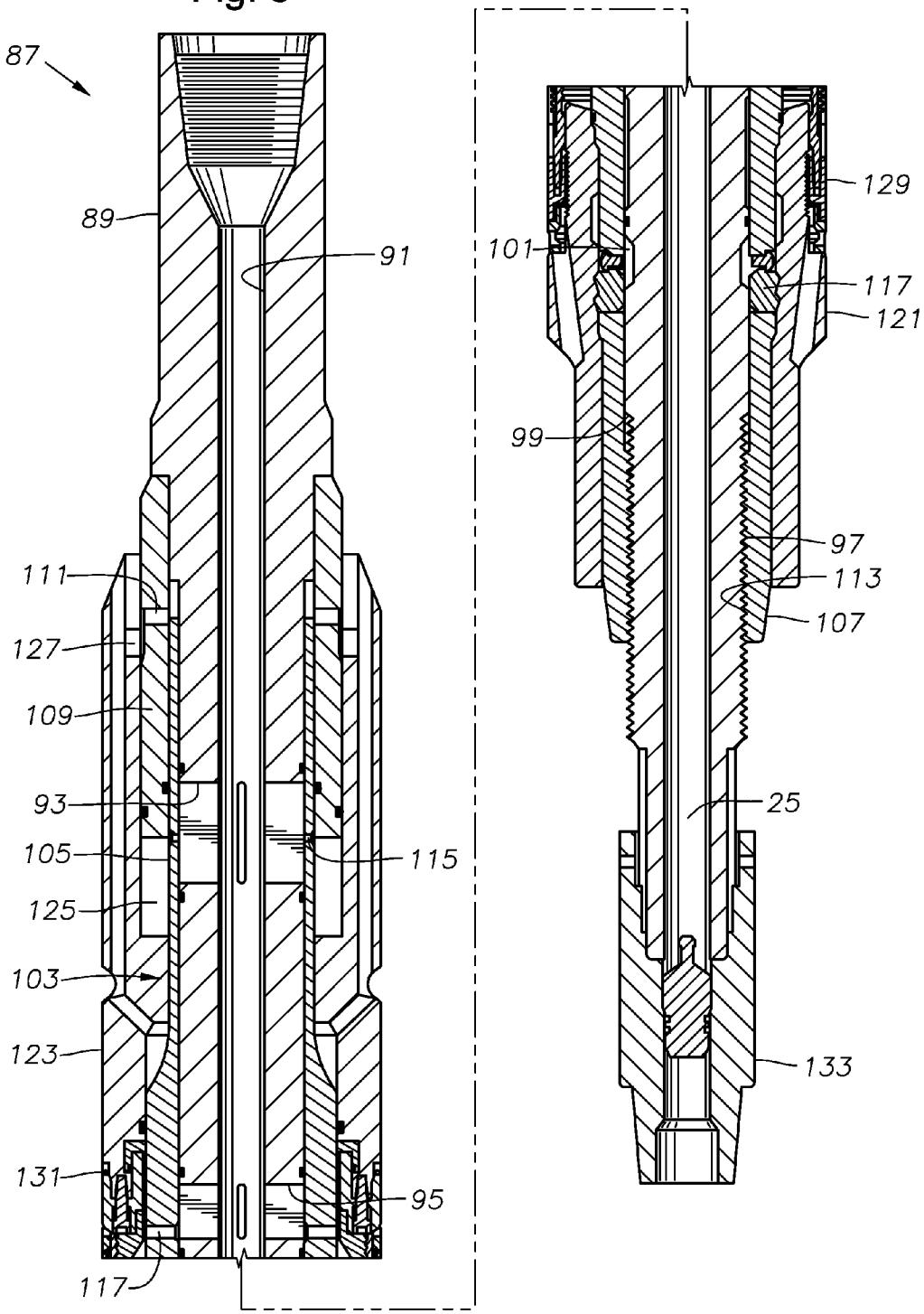
FIG. 8 is a sectional view of the HCRT of FIG. 5 in a seal testing position.

Referring to FIG. 8, once piston 123 is driven downward and casing hanger packoff seal 129 is set, stem 89 is then rotated four additional revolutions in the same direction. As stem 89 is rotated relative to body 103, stem 89 moves further longitudinally downward relative to body 103 and casing hanger 121. Stem 89 also moves downward at this point relative to piston 123. As stem 89 moves longitudinally, stem ports 93, 95 and body ports 115, 117 also move relative to one another. Lower stem port 95 aligns with lower body port 117, allowing fluid communication from axial passage 91 of stem 89, through stem 89, into and through body 103, and into an isolated volume above casing hanger packoff seal 129. Upper stem port 93 is still aligned with upper body port 115. The latch device located with slot 111 on outer sleeve 109 is activated by the movement of stem 89 and will act in conjunction with piston locking ring 127 to restrict the upward movement of piston 123 beyond the latch device. Pressure is applied down the drill pipe and travels through axial passage 91 of stem 89 before passing through lower stem port 93, lower body port 115, and into an isolated volume above casing hanger packoff seal 129, thereby testing casing hanger packoff seal 129. The same pressure is applied to piston 123, creating an upward force, however, movement of piston 123 in an upward direction is restricted by the engagement of piston locking ring 127 and the latch device (not shown) positioned in slot 111 on outer sleeve 109. In an alternate embodiment, the size of the fluid chambers in piston 123 and seal 129 areas could be sized such that the larger sized fluid chamber in seal 129 area maintains a downward force on piston 123, thereby eliminating the need for the latch device and piston locking ring 127. An elastomeric seal 131 is mounted to the exterior of piston 123 for sealing against the inner diameter of the wellhead housing. Seal 131 defines the isolated volume above casing hanger packoff seal 129. If casing hanger packoff seal 129 is not properly set, a drop in fluid pressure held in the drill pipe will be observed as the fluid passes through the seal area.

Figure 9:
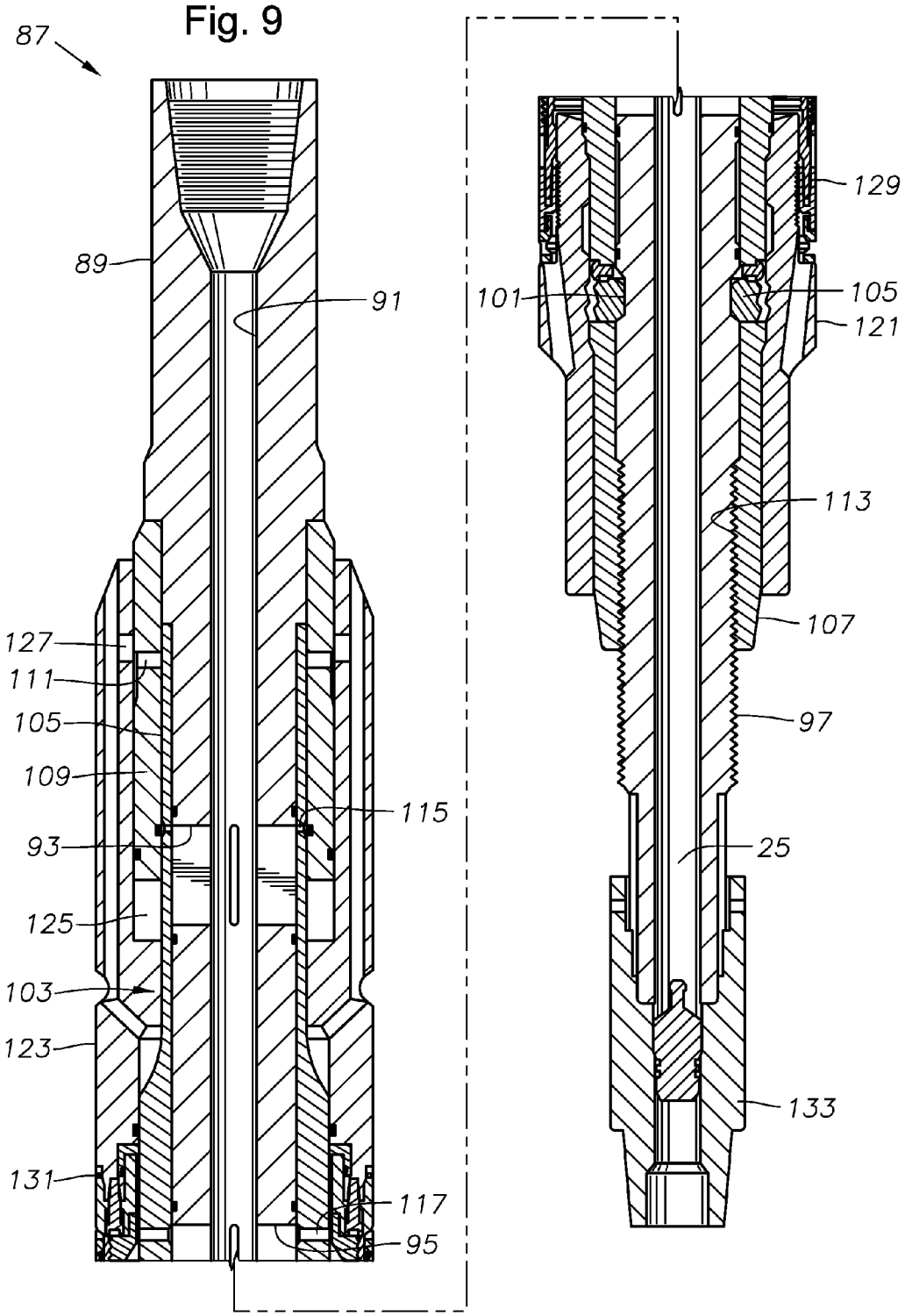
FIG. 9 is a sectional view of the HCRT of FIG. 5 in an unlocked position with the engagement element disengaged.

Referring to FIG. 9, once the casing hanger packoff seal 129 has been tested, stem 89 is then rotated four additional revolutions in the same direction. As stem 89 is rotated relative to body 103, stem 89 moves further longitudinally downward relative to body 103, casing hanger 121, and piston 123. As stem 89 moves longitudinally downward, the engaging element 119 is freed and moves radially inward into recessed pocket 101 on the outer surface of stem 89, thereby unlocking body 103 from casing hanger 121. Upper stem port 93 remains aligned with upper body port 115. Lower stem port 95 may remain aligned with lower body port 117. Lower stem port 95 and lower body port 117 may partially vent the column of fluid in the drill pipe. Thus, universal dart launcher 11 may launch a dart 25 down a running string to actuate a running tool 87 to set a seal 129.

Accordingly, the disclosed embodiments provide numerous advantages. For example, the universal dart launcher described herein decreases the likelihood of a stuck or hung up dart or ball during launch by providing a launch path for the dart that does not require the dart to navigate a turn. In addition, the universal dart launcher described herein provides an unrestricted non-launching flow path that reduces the instances of a blocked passage or inadvertent launching of the dart or ball. Furthermore, the disclosed embodiments may be secured directly to a cement head for operation of the universal dart launcher. The disclosed embodiments also provide a dart launcher that has a significantly shorter stack up height compared to prior art launchers. The disclosed universal dart launcher may also be easily adapted to various sizes of darts and balls as well as decreasing safety issues by allowing for remote operation of the launcher.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A wellbore drop member launcher comprising:

a launcher body defining a central bore having an axis, the launcher body having a lower end configured to attach to a string of pipe extending into a wellbore;

a cartridge housed within the launcher body so that the cartridge can selectively move perpendicular to the axis from a first position to a second position within the launcher body, the cartridge defining a drop member bore extending axially through the cartridge and having a generally constant diameter that is substantially the same as the diameter of the central bore;

a drop member positioned within the cartridge so that the drop member will be in a sidewall of the launcher body while the cartridge is in the first position, and will be in axial alignment with the central bore while the cartridge is in the second position; and an actuator assembly coupled to, and extending radially outward from, the launcher body, the actuator assembly having an actuation rod coupled to the cartridge so that the actuator assembly is operable to move the cartridge from the first position to the second position.

2. The wellbore drop member launcher of claim 1, further comprising:

a cartridge slot intersecting the central bore and having a radially extending width greater than a diameter of the central bore; and wherein the cartridge is located within the cartridge slot.

3. The wellbore drop member launcher of claim 1, wherein the launcher body has forward and rearward sides having greater radial width than opposite lateral sides.

4. The wellbore drop member launcher of claim 1, wherein the launcher body includes an upper and lower coupling to allow the launcher body to selectively couple inline with a string of pipe.

5. The wellbore drop member launcher of claim 1, wherein the cartridge comprises:

the cartridge defining an axially extending open bore having a diameter that is substantially the same as the diameter of the central bore; and the cartridge moveable within the launcher body so that the open bore is aligned with the central bore in the first position and the drop member bore is aligned with the central bore in the second position.

6. The wellbore drop member launcher of claim 5, wherein the cartridge further defines an actuator slot on a lateral side of the cartridge to allow the actuator assembly to couple to the cartridge.

7. The wellbore drop member launcher of claim 1, wherein the actuator assembly comprises a fluid powered piston.

8. The wellbore drop member launcher of claim 1, wherein the actuator assembly comprises a gas powered piston.

9. The wellbore drop member launcher of claim 1, further comprising a retraction spring in the actuator assembly that exerts a force biasing the cartridge to the first position.

10. The wellbore drop member launcher of claim 1, wherein the actuator assembly further comprises:

an attachment body coupled to the launcher body;

a retraction spring having a first end abutting an outwardly facing shoulder of the attachment body;

an actuation chamber coupled to the attachment body, the actuation chamber having an opening in a first end to allow the retraction spring to insert into the actuation chamber;

a piston moveably positioned within the actuation chamber so that a second end of the retraction spring abuts a first surface of the piston; and the actuation rod is further coupled to the piston so that the cartridge will move within the launcher body in response to movement of the piston.

11. The wellbore drop member launcher of claim 1, wherein the launcher body further defines enlarged bore sections above and below the central bore section with tapered portions joining the two.

12. A wellbore drop member launcher comprising:

a launcher body defining a central bore having an axis, the launcher body having a lower end configured to attach to a string of pipe extending into a wellbore;

the launcher body further defining a cartridge slot intersecting the central bore and having a radially extending width greater than a diameter of the central bore;

a cartridge housed within the launcher body so that the cartridge can selectively move perpendicular to the axis from a first position to a second position within the cartridge slot;

the cartridge defining an axially extending open bore having a diameter that is substantially the same as the diameter of the central bore;

the cartridge further defining an axially extending drop member bore having a generally constant diameter that is substantially the same as the diameter of the central bore;

the cartridge moveable within the launcher body so that the open bore is aligned with the central bore in the first position and the drop member bore is aligned with the central bore in the second position;

a drop member positioned within the cartridge so that the drop member will be in a sidewall of the launcher body while the cartridge is in the first position, and will be in axial alignment with the central bore while the cartridge is in the second position; and an actuator assembly coupled to, and extending radially outward from, the launcher body, the actuator assembly having an actuation rod coupled to the cartridge so that the actuator assembly is operable to move the cartridge from the first position to the second position, the actuator assembly further having a spring that biases the actuator assembly and the cartridge to the first position.

13. The wellbore drop member launcher of claim 12, wherein the actuator assembly comprises a fluid powered piston.

14. The wellbore drop member launcher of claim 12, wherein the actuator assembly comprises a gas powered piston.

15. The wellbore drop member launcher of claim 12, wherein the launcher body further defines enlarged bore sections above and below central bore section with tapered portions joining the two.

16. A method for launching a drop member into a wellbore pipe string, comprising:

(a) providing a launcher body having a central bore with an axis and a slot joining and extending from the central bore perpendicular to the axis;

(b) locating a cartridge in the slot, the cartridge defining a drop member bore extending axially through the cartridge and having a generally constant diameter that is substantially the same as the diameter of the central bore;

(c) placing a drop member in the drop member bore laterally spaced from the central bore so that the drop member is located in a sidewall of the launcher body;

(c) coupling the launcher body in line with the pipe string so that the central bore of the launcher body aligns with a body passage through the pipe string; and (d) applying a force to a piston coupled to, and extending radially from, the launcher body, thereby moving the piston perpendicular to the axis and urging the drop member laterally through the slot into the central bore to allow the drop member to move down the pipe string.

17. The method of claim 16, further comprising biasing the piston to the position of step (c).

18. The method of claim 16, wherein step (b) comprises:

providing a cartridge defining an open bore and a drop member bore alongside and parallel with the open bore;

placing the drop member in the drop member bore and aligning the open bore with the central bore; and step (d) comprises pushing the piston laterally to align the drop member bore axially with the central bore.

19. A well tool assembly comprising:

a running tool adapted to be coupled to a running string and having at least one hydraulically actuated function;

a drop member launcher adapted to be coupled to an upper end of the running string, the drop member launcher having a central bore capable of fluid communication with a central bore of the running string and the running tool the drop member launcher further comprising a cartridge housed within the launcher body, and a radially extending actuator assembly with an actuation rod, the cartridge defining a drop member bore extending axially through the cartridge and having a generally constant diameter that is substantially the same as a diameter of the central bore; and the actuation rod configured to move a drop member within the drop member launcher perpendicular from a sidewall of the to the central bore of the drop member launcher to place the drop member inline with the central bore of the running string so that the drop member will travel down the running string to land in a landing sub of the running tool.

20. The well tool assembly of claim 19, wherein:

the launcher body defines a central bore having an axis, the launcher body having a lower end configured to attach to a string of pipe extending into a wellbore and an upper end configured for attachment to a source of fluid to be pumped down the string of pipe;

the cartridge can selectively move perpendicular to the axis from a first position to a second position within the launcher body;

the drop member will not be in axial alignment with the central bore while the cartridge is in the first position, and will be in axial alignment with the central bore while the cartridge is in the second position; and wherein the actuator assembly is operable to move the cartridge from the first position to the second position.

21. The well tool assembly of claim 19, wherein:

the cartridge defines an axially extending open bore having a diameter that is substantially the same as the diameter of the central bore; and the cartridge is moveable within the launcher body so that the open bore is aligned with the central bore in the first position and the drop member bore is aligned with the central bore in the second position.

22. The well tool assembly of claim 19, wherein the actuator assembly comprises:

an attachment body coupled to the launcher body;

a retraction spring having a first end abutting an outwardly facing shoulder of the attachment body;

an actuation chamber coupled to the attachment body, the actuation chamber having an opening in a first end to allow the retraction spring to insert into the actuation chamber;

a piston moveably positioned within the actuation chamber so that a second end of the retraction spring abuts a first surface of the piston; and wherein the actuation rod is coupled to the piston and further coupled to the cartridge so that the cartridge will move within the launcher body in response to movement of the piston.

23. A method for operating a running tool, comprising:

(a) providing a well tool assembly, the well tool assembly having:

a running tool adapted to be coupled to a running string and having at least one hydraulically actuated function;

a landing sub coupled to a lower end of the running tool;

a drop member launcher having launcher body and a cartridge, the cartridge defining a drop member bore extending axially through the cartridge and having a diameter that is generally constant; the drop member launcher coupled to an upper end of the running string opposite the running tool; and a drop member located in the drop member bore;

(b) moving the drop member perpendicular to a central bore of the drop member launcher from a first position that is within a sidewall of the launcher body to a second position with an actuation rod of a radially extending actuator assembly to align the drop member with a central bore of the running string;

(c) moving the drop member down the running string to land in the landing sub, thereby blocking fluid flow through the landing sub and hydraulically actuating the running tool; then (d) supplying fluid pressure to the running tool at a first pressure to actuate the running tool to perform a function.

24. The method of claim 23, wherein step (b) comprises moving the cartridge of the drop member launcher from the first position, wherein an open bore of the cartridge is inline with the central bore of the drop member launcher, to a second position, wherein the drop member bore carrying the drop member is inline with the central bore of the drop member launcher.

25. The method of claim 24, wherein step (b) comprises applying hydraulic pressure to a piston to move the cartridge laterally through the drop member launcher.

26. The method of claim 24, wherein step (b) comprises applying pneumatic pressure to a piston to move the cartridge laterally through the drop member launcher.

27. The method of claim 24, wherein step (b) comprises applying a mechanical force to a piston to move the cartridge laterally through the drop member launcher.

28. The method of claim 23, wherein the function of step (d) comprises actuating the running tool to set an annular seal.

* * * * *